US009989221B2

(12) United States Patent
Yamamoto

(10) Patent No.: US 9,989,221 B2
(45) Date of Patent: Jun. 5, 2018

(54) INSULATED RADIATING RUBBER MOLDED ARTICLE

(71) Applicant: NOK CORPORATION, Tokyo (JP)

(72) Inventor: Hiroki Yamamoto, Fujisawa (JP)

(73) Assignee: NOK Corporation (JP)

( * ) Notice: Subject to any disclaimer, the term of this patent is extended or adjusted under 35 U.S.C. 154(b) by 332 days.

(21) Appl. No.: 14/385,875

(22) PCT Filed: Feb. 14, 2013

(86) PCT No.: PCT/JP2013/053447
§ 371 (c)(1),
(2) Date: Sep. 17, 2014

(87) PCT Pub. No.: WO2013/153849
PCT Pub. Date: Oct. 17, 2013

(65) Prior Publication Data

US 2015/0070913 A1 Mar. 12, 2015

(30) Foreign Application Priority Data

Apr. 9, 2012 (JP) ..... 2012-088076

(51) Int. Cl.
*F21V 15/06* (2006.01)
*F21K 99/00* (2016.01)
(Continued)

(52) U.S. Cl.
CPC ..... *F21V 15/06* (2013.01); *F21K 9/232* (2016.08); *F21V 19/0055* (2013.01);
(Continued)

(58) Field of Classification Search
CPC ..... H01L 33/642
See application file for complete search history.

(56) References Cited

U.S. PATENT DOCUMENTS 7,196,413 B2 * 3/2007 Shibuya ..... C09K 5/14 257/706
8,130,499 B2 * 3/2012 Ohnishi ..... H01L 23/053 174/16.3
(Continued)

FOREIGN PATENT DOCUMENTS

CN 102168817 A 8/2011
EP 2104121 A1 9/2009
(Continued)

OTHER PUBLICATIONS

Extended European Search Report for Application No. EP 13 77 5604 dated Mar. 10, 2015 (4 pages).

*Primary Examiner* — Robert Carpenter
(74) *Attorney, Agent, or Firm* — Harness, Dickey & Pierce, P.L.C.

(57) ABSTRACT

Provided is an insulated radiating rubber molded article that can be pre-installed in an electrical apparatus such as an LED package, can improve handling properties during attachment work, and moreover can exert superior insulating characteristics and radiating characteristics. To achieve the objective, the insulated radiating rubber molded article, which, by means of being interposed between a base and the electrical apparatus when attaching the electrical apparatus, which emits heat alongside the operation thereof, to the base, promotes radiating from the electrical apparatus and electrically insulates the electrical apparatus from the base, is characterized by having a 3D shape by means of being integrally provided with: a flat surface section disposed between the electrical apparatus and the base; and a lateral surface section disposed around the electrical apparatus.

5 Claims, 2 Drawing Sheets

(51) Int. Cl.

| | |
|---|---|
| ***F21V 19/00*** | (2006.01) |
| ***F21V 29/00*** | (2015.01) |
| ***F21V 29/15*** | (2015.01) |
| ***F21K 9/232*** | (2016.01) |
| *F21Y 115/10* | (2016.01) |

(52) U.S. Cl.
CPC ..... *F21V 29/002* (2013.01); *F21V 29/15* (2015.01); *F21Y 2115/10* (2016.08)

(56) References Cited

U.S. PATENT DOCUMENTS

| | | | | |
|---|---|---|---|---|
| 2005/0205989 | A1 | 9/2005 | Shibuya et al. | |
| 2007/0285926 | A1 | 12/2007 | Maxik | |
| 2011/0074271 | A1* | 3/2011 | Takeshi ..... | F21V 19/004 313/46 |
| 2011/0210664 | A1 | 9/2011 | Hisayasu et al. | |

FOREIGN PATENT DOCUMENTS

| | | | |
|---|---|---|---|
| EP | 2120263 | A1 | 11/2009 |
| EP | 2362135 | A1 | 8/2011 |
| JP | 2001-057406 | A | 2/2001 |
| JP | 2004-200207 | A | 7/2004 |
| JP | 2011-181248 | A | 9/2011 |
| JP | 2011-187220 | A | 9/2011 |
| WO | WO-2008-026516 | A1 | 3/2008 |

* cited by examiner

- PRIOR ART -

- PRIOR ART -

INSULATED RADIATING RUBBER MOLDED ARTICLE

CROSS-REFERENCE TO RELATED APPLICATIONS

This application is a U.S. National Stage Application of International Application No. PCT/JP2013/053447 filed on Feb. 14, 2013, and published in Japanese as WO 2013/153849 A1 on Oct. 17, 2013. This application claims priority to Japanese Application No. 2012-088076 filed on Apr. 9, 2012. The entire disclosures of the above applications are incorporated herein by reference.

BACKGROUND OF THE INVENTION

Field of the Invention

The present invention relates to a rubber molded article, and more particularly to an insulated radiating rubber molded article for promoting heat radiation from an electrical apparatus by being interposed between the electrical apparatus and a base at the attaching time of the electrical apparatus generating heat according to an actuation to the base, and for electrically insulating between the electrical apparatus and the base. The rubber molded article according to the present invention is used, for example, in a relevant field to an LED lighting equipment, or all the fields which require heat radiation performance and insulation performance in the other heat radiating parts.

Description of the Conventional Art

For example, the LED generates heat at the lighting time, and temperature of the LED rises if the heat generation is not efficiently dissipated. As a result, a circuit part is deteriorated little by little and is finally damaged, and its service life becomes short. Further, high insulation performance is required in the lighting fixture so that the lighting fixture is not broken when abnormal voltage is applied due to lighting stroke, and an insulation test is under obligation to do.

Accordingly, as shown in FIG. 3, an LED package 21 is attached to a base body of a lighting equipment or a base 25 of an aluminum heat sink via an insulative sheet 24 having a heat conductivity, the LED package being used in the lighting equipment (being structured such that a light emitting element circuit 23 is formed on a base plate 22 made of an aluminum) (refer to Japanese Unexamined Patent Publication No. 2011-181248).

Here, the insulative sheet 24 used in the structure mentioned above is necessary to be installed larger than a magnitude of the aluminum base plate 22 for more securely preventing short circuit between the aluminum base plate 22 of the LED package 21 and the base 25. As a result, the insulative sheet 24 is set to a flat surface shape which is slightly larger than the aluminum base plate 22.

However, the insulative sheet 24 is formed into a sheet shape as its name suggests, and is only one planate rubber molded article. Therefore, the planate insulative sheet 24 can not be previously assembled in the LED package 21, and both the elements 21 and 24 can not be handled as an integral article. It is necessary to alight both the elements 21 and 24 every time when the LED package 21 is attached to the base 25, and handling property at the attaching work time is not good.

SUMMARY OF THE INVENTION

Problem to be Solved by the Invention

The present invention is made by taking the above point into consideration, and an object of the present invention is to provide an insulated radiating rubber molded article which can be previously assembled in an electrical apparatus such as an LED package so as to improve handling property at the attaching work time, and can achieve excellent insulation performance and heat radiation performance.

Means for Solving the Problem

In order to achieve the object mentioned above, an insulated radiating rubber molded article according to a first aspect of the present invention is an insulated radiating rubber molded article promoting heat radiation from an electrical apparatus generating heat according to actuation and electrically insulating between the electrical apparatus and a base by being interposed between the electrical apparatus and the base when the electrical apparatus is attached to the base, wherein the insulated radiating rubber molded article is formed into a stereoscopic shape by being integrally provided with a flat surface section and a lateral surface section, the flat surface section being arranged between the electrical apparatus and the base, and the lateral surface section being arranged around the electrical apparatus.

Further, an insulated radiating rubber molded article according to a second aspect of the present invention is the insulated radiating rubber molded article described in the first aspect mentioned above, wherein the stereoscopic shape is obtained by being integrally provided with an attaching screw surrounding portion which is arranged around an attaching screw, in addition to the lateral surface section.

Further, an insulated radiating rubber molded article according to a third aspect of the present invention is the insulated radiating rubber molded article described in the second aspect mentioned above, wherein the lateral surface section and/or the attaching screw surrounding portion is set so that a height is equal to or more than a thickness of the electrical apparatus.

Further, an insulated radiating rubber molded article according to a fourth aspect of the present invention is the insulated radiating rubber molded article described in the first, second or third aspect mentioned above, wherein the electrical apparatus is constructed by a lighting equipment, particularly an LED package.

The insulated radiating rubber molded article according to the present invention having the structure mentioned above is formed into the stereoscopic shape in place of a simple planate shape by being integrally provided with the flat surface section and the lateral surface section, the flat surface section being arranged between the electrical apparatus and the base, and the lateral surface section being arranged around the electrical apparatus. The lateral surface section can be previously assembled in the electrical apparatus in such a manner that the lateral surface section is fitted around the electrical apparatus. Therefore, it is possible to improve handling property at the attaching work time, by previously assembling the insulated radiating rubber molded article in the electrical apparatus and thereafter attaching the insulated radiating rubber molded article and the electrical apparatus to the base.

Further, since the insulated radiating rubber molded article is provided with the lateral surface section which is arranged around the electrical apparatus, the lateral surface section forms a new insulating layer which suppresses short circuit between the electrical apparatus and the base. In other words, if the lateral surface section is not provided, the insulated radiating rubber molded article is arranged at a position which is deviated on plane in relation to the electrical apparatus. Accordingly, there is fear that the electrical apparatus and the base come into direct contact with each other and are short-circuited. However, according to the present invention, since the lateral surface section achieves an aligning function with the electrical apparatus, the insulated radiating rubber molded article is accurately aligned on plane with the electrical apparatus. Therefore, the electrical apparatus does not come into contact with the base, but is hard to be short-circuited. As a result, it is possible to improve the insulation performance.

Further, since the insulated radiating rubber molded article is provided with the lateral surface section which is arranged around the electrical apparatus, the lateral surface section forms the new heat radiating layer which absorbs the heat generation of the electrical apparatus. Therefore, it is possible to improve the heat radiation performance.

In the case that the electrical apparatus is attached to the base by the attaching screw, there is fear that the electrical apparatus and the base are short-circuited therebetween via the attaching screw. Accordingly, in this case, the attaching screw surrounding portion arranged around the attaching screw is integrally provided in the insulated radiating rubber molded article, in addition to the lateral surface section, and the electrical apparatus and the attaching screw are insulated therebetween by the attaching screw surrounding portion. The attaching screw surrounding portion forms the stereoscopic shape of the rubber molded article together with the lateral surface section.

Further, the lateral surface section and/or the attaching screw surrounding portion is preferably set so that the height is equal to or more than the thickness of the electrical apparatus. In this case, a contact area of the lateral surface section and/or the attaching screw surrounding portion in relation to the thickness surface of the electrical apparatus becomes maximum. Therefore, it is possible to secure sufficient insulation performance, and it is possible to obtain the maximum heat radiation performance (heat absorbing performance) in relation to the thickness surface of the electrical apparatus.

The lighting equipment, particularly the LED package can be listed up as a typical example of the electrical apparatus. The lighting equipment, particularly the LED package is a subject to be assembled, in which the insulation performance and the heat radiation performance are both required.

Effect of the Invention

The present invention achieves the following effects.

More specifically, in the present invention, as described above, the insulated radiating rubber molded article is formed into the stereoscopic shape by being integrally provided with the flat surface section and the lateral surface section, the flat surface section being arranged between the electrical apparatus and the base, and the lateral surface section being arranged around the electrical apparatus. The lateral surface section can be previously assembled in the electrical apparatus in such a manner that the lateral surface section is fitted around the electrical apparatus. Therefore, it is possible to improve the handling property at the attaching work time, by previously assembling the insulated radiating rubber molded article in the electrical apparatus and thereafter attaching the insulated radiating rubber molded article and the electrical apparatus to the base. Further, since the new insulating layer and heat radiating layer are formed by the lateral surface section, it is possible to improve the insulation performance and the heat radiation performance as a whole of the rubber molded article.

In the case that the insulated radiating rubber molded article is integrally provided with the attaching screw surrounding portion in addition to the lateral surface section, the attaching screw surrounding portion insulates between the electrical apparatus and the attaching screw. Therefore, it is possible to suppress the short circuit between the electrical apparatus and the base via the attaching screw. In the case that the height of the lateral surface section and/or the attaching screw surrounding portion is set to be equal to or more than the thickness of the electrical apparatus, the contact area of the lateral surface section and/or the attaching screw surrounding portion in relation to the thickness surface of the electrical apparatus becomes maximum. Therefore, it is possible to obtain the sufficient insulation performance and the maximum heat radiation performance.

DETAILED DESCRIPTION OF PREFERRED EMBODIMENT

Next, a description will be given of an embodiment according to the present invention with reference to the accompanying drawings.

Figure 1:
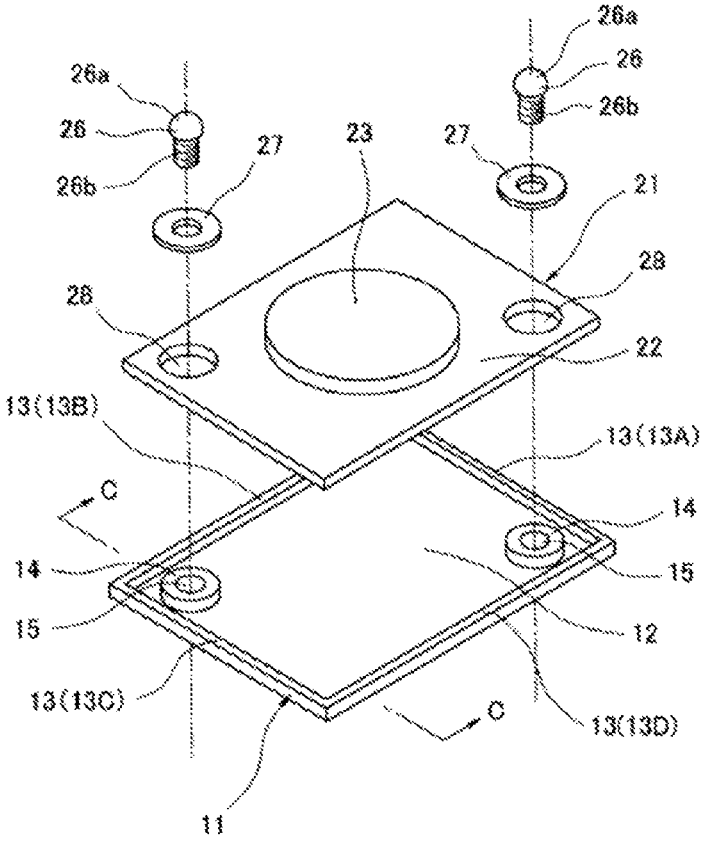
FIG. 1 is an explanatory view when an insulated radiating rubber molded article according to an embodiment of the present invention is combined with an LED package.
Figure 2:
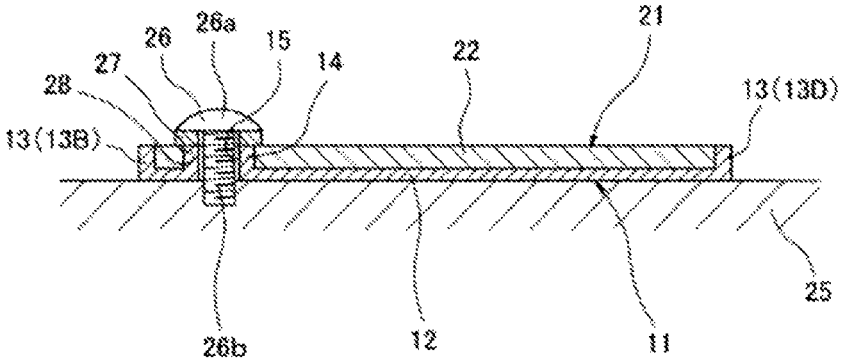
FIG. 2 is an explanatory view of a state in which the insulated radiating rubber molded article is combined with the LED package, and is a cross sectional view along a line C-C in FIG. 1.

As shown in FIGS. 1 and 2, an insulated radiating rubber molded article 11 according to an embodiment of the present invention is assembled in an LED package 21 which is a kind of electrical apparatus (lighting equipment). The insulated radiating rubber molded article 11 is also called as an insulation sheet having heat radiation performance (heat conduction) in the light of its providing function.

The insulated radiating rubber molded article 11 and the LED package 21 are attached to a base body of a lighting equipment or a base 25 of an aluminum heat sink by an attaching screw 26 with a washer 27.

The LED package 21 is structured such that a light emitting element circuit 23 is formed on a base plate 22 made of aluminum, and insulation performance is necessary in the insulated radiating rubber molded article 11 for preventing short circuit between the aluminum base plate 22 and the base 25 in an attached state shown in FIG. 2.

Further, since the LED package 21 generates heat at the operating time (the lighting time), heat radiation performance is necessary in the insulated radiating rubber molded article 11 for preventing an overheat state, and high heat conduction is accordingly necessary.

Therefore, the insulated radiating rubber molded article 11 is formed by a rubber material having the insulation performance and the high heat conduction (for example, a silicone rubber blended with an insulative and heat conductive filler).

The insulated radiating rubber molded article 11 is provided with a plate-like flat surface section 12 which is arranged between the aluminum base plate 22 of the LED package 21 and the base 25, and a lateral surface section 13 arranged around the aluminum base plate 22 of the LED package 21 is integrally formed in the flat surface section 12.

As a result, the insulated radiating rubber molded article 11 is formed into a stereoscopic shape, that is, a tray shape in place of a planate shape as a whole.

Further, an attaching screw surrounding portion 14 arranged around the attaching screw 26 is integrally formed in conjunction with the flat surface section 12. According to this structure, the insulated radiating rubber molded article 11 is also formed into the stereoscopic shape in place of the planate shape as a whole.

Since the aluminum base plate 22 of the LED package 21 is formed into a rectangular flat surface, the flat surface section 12 is formed into a rectangular flat surface, and the lateral surface section 13 is formed over an entire length of four peripheral sides, that is, over an entire periphery of a peripheral edge portion of the flat surface section 12 so as to rise toward one side in a thickness direction of the flat surface section 12.

The respective surface sections 13 of these four sides are differentiated by attaching reference symbols 13A, 13B, 13C and 13D. A distance between the lateral surface sections 13A and 13C of two sides facing to each other is set to be equal to a length (a vertical length) of the aluminum base plate 22 of the corresponding LED package 21. Further, a distance between the lateral surface sections 13B and 13D of the other two sides which are orthogonal thereto is set to be equal to a length (a transverse width) of the aluminum base plate 22 of the corresponding LED package 21. Therefore, the lateral surface section 13 can be detachably fitted around the aluminum base plate 22 of the LED package 21.

A height of the lateral surface section 13 is set to be equal to or more than a thickness of the aluminum base plate 22 of the LED package 21 (for example, a dimensional difference about 0.1 mm).

Further, since the aluminum base plate 22 of the LED package 21 is provided with a screw insertion hole 28 which passes a screw portion 26*b* of the attaching screw 26 with a head portion 26*a* thereto, the attaching screw surround portion 14 is formed into a size that the attaching screw surrounding portion 14 can be inserted to the screw insertion hole 28. Since the screw insertion hole 28 is formed into a circular hole, the attaching screw surrounding portion 14 is formed into a cylindrical shape, and an inner diameter of the circular hole is set to be equal to an outer diameter of the cylinder. An inner periphery of the attaching screw surrounding portion 14 is formed into a screw insertion hole 15 which passes the screw portion 26*b* of the attaching screw 26 thereto, and the screw insertion hole 15 passes through the flat surface section 12 in a thickness direction.

A height of the attaching screw surrounding portion 14 is set to be equal to or more than a thickness of the aluminum base plate 22 of the LED package 21 (for example, a dimensional difference about 0.1 mm). Therefore, the height of the attaching screw surrounding portion 14 is frequently set to be equal to the height of the lateral surface section 13.

Since the attaching screws 26 are used over two positions on a diagonal line of the aluminum base plate 22 of the LED package 21, the screw insertion holes 28 of the aluminum base plate 22, and the attaching screw surrounding portions 14 and the screw insertion holes 15 of the insulated radiating rubber molded article 11 are provided over two positions in the same manner.

The insulated radiating rubber molded article 11 having the structure mentioned above is assembled in the LED package 21 by fitting the lateral surface section 13 to an outer periphery of the aluminum base plate 22 of the LED package 21, and inserting the attaching screw surrounding portions 14 to the screw insertion holes 28 of the aluminum base plate 22, and is thereafter attached to the base 25 together with the LED package 21 by the attaching screws 26, as shown in FIG. 2. The insulated radiating rubber molded article 11 has a feature in a point that the following operations and effects can be achieved by the structure mentioned above.

More specifically, the insulated radiating rubber molded article 11 having the structure mentioned above is formed into the stereoscopic shape by integrally having the flat surface section 12 which is arranged between the aluminum base plate 22 of the LED package 21 and the base 25, the lateral surface section 13 which is arranged around the aluminum base plate 22 of the LED package 21, and the attaching screw surrounding portions 14 which are arranged around the attaching screws 26, and can be previously assembled in the LED package 21 by fitting the lateral surface section around the aluminum base plate 22 of the LED package 21, and inserting the attaching screw surrounding portions 14 to the screw insertion holes 28 of the aluminum base plate 22. Therefore, it is possible to improve handling property at the attaching work time by previously assembling the insulated radiating rubber molded article in the LED package 21, and thereafter attaching the insulated radiating rubber molded article and the LED package 21 to the base 25.

Further, since the insulated radiating rubber molded article 11 is provided with the lateral surface section 13 which is arranged around the aluminum base plate 22 of the LED package 21, the lateral surface section 13 forms an insulating layer which suppresses the short circuit between the aluminum base plate 22 of the LED package 21 and the base 25. Further, since the insulated radiating rubber molded article 11 is provided with the attaching screw surrounding portions 14 which are arranged around the attaching screws 26, the attaching screw surrounding portions 14 form the insulating layer which suppresses the short circuit between the aluminum base plate 22 of the LED package 21 and the base 25 via the attaching screws 26. Therefore, since these insulating layers are added, it is possible to improve the insulation performance as a whole of the rubber molded article 11.

Further, since the insulated radiating rubber molded article 11 is provided with the lateral surface section 13 which is arranged around the aluminum base plate 22 of the LED package 21, the lateral surface section 13 forms a heat radiating layer which absorbs heat generation of the LED package 21. Further, since the insulated radiating rubber molded article 11 is provided with the attaching screw surrounding portions 14 which are arranged around the attaching screws 26 and inserted to the screw insertion holes of the aluminum base plate 22, the attaching screw surrounding portions 14 form the heat radiating layer which absorbs heat generation of the LED package 21. Therefore, since these heat radiating layers are added, it is possible to improve the heat radiation performance as a whole of the rubber molded article 11.

The inventors of the present invention prepared the rubber molded article 11 having the shape in FIGS. 1 and 2 by using the rubber material in which the heat conduction is equal to or more than 0.5 W/m·K, and the insulation performance is equal to or more than 1 TΩ·m, and assembled the rubber molded article 11 in the LED and the heat sink so as to use. As a result, it was possible to confirm that the LED is not broken even under withstand voltage test 1.5 KV, and the heat generation at the continuous operating time can be suppressed. Therefore, it is possible to achieve a long service life of the LED.

Figure 3A:
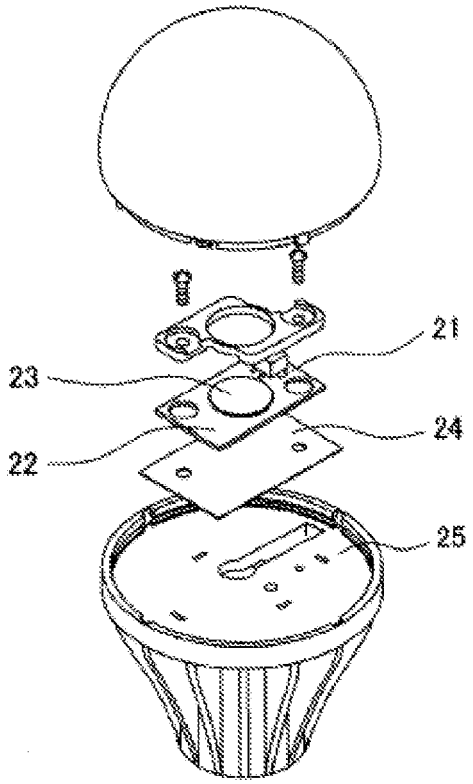
FIGS. 3A and 3B are explanatory views according to a prior art.
Figure 3B:
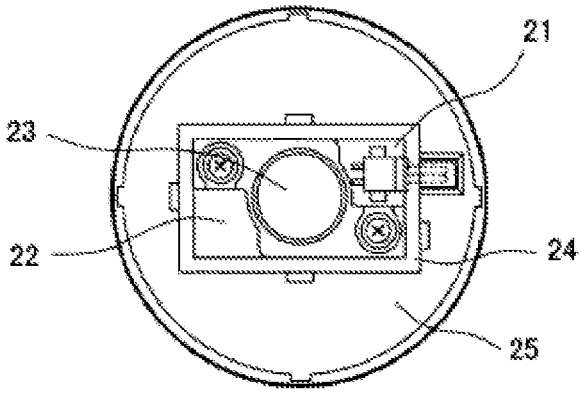

Further, the insulated radiating rubber molded article 11 having the structure mentioned above can downsize the flat surface shape and reduce the installing space in comparison with the conventional structure. In other words, in the prior art in FIG. 3 mentioned above, the insulative sheet 24 is set to the flat surface shape which is slightly larger than the aluminum base plate 22 and the position (the protruding portion) which protrudes out of the flat surface shape of the aluminum base plate 22 is provided in the peripheral edge portion of the insulative sheet 24, for securely preventing the short circuit between the aluminum base plate 22 of the LED package 21 and the base 25, as mentioned above. However, in the embodiment according to the present invention, the lateral surface section 13 is provided in place of the protruding portion. Therefore, in the case that the thickness of the lateral surface section 13 is smaller than the protruding size of the protruding portion, it is possible to downsize the flat surface shape of the rubber molded article 11, and it is possible to reduce the installing space. Since the protruding size of the protruding portion in the prior art is generally about 5 mm, it is sufficient that the thickness of the lateral surface section 13 is smaller than the protruding size, however, since the thickness of the lateral surface section 13 is set, for example, to about 0.5 mm, it is possible to greatly achieve the downsizing of the flat surface shape and the reduction of the installing space.

Further, with regard to the embodiment, there can be thought that the structure is additionally provided and is changed as follows.

(1) In the embodiment mentioned above, the heights of the lateral surface section 13 and the attaching screw surrounding portion 13 are set to be equal to or more than the thickness of the aluminum base plate 22 of the LED package 21. However, in place of this, the height of the lateral surface section 13 and/or the attaching screw surrounding portion 13 is set to be so smaller as to generate no short circuit than the thickness of the aluminum base plate 22 of the LED package 21. In this case, it is possible to obtain the heat radiation performance in correspondence to the height, that is, the magnitude of the contact area with the thickness surface of the aluminum base plate 22. In the case that the height of the lateral surface section 13 and/or the attaching screw surrounding portion 14 is set to be larger than the thickness of the aluminum base plate 22 of the LED package 21, it is possible to more certainly secure the insulation.

(2) In the case that the attaching screw 26 is made of a conductive material such as a metal, the washer 27 is preferably made of a non-conductive material such as a resin, in the light of retention of the insulation performance. However, the insulation performance can be retained even in the case that the attaching screw 26 is made of the non-conductive material such as the resin.

What is claimed is:

1. An insulated radiating rubber molded article promoting heat radiation from an electrical apparatus generating heat according to actuation and electrically insulating between said electrical apparatus and a base by being interposed between said electrical apparatus and the base when said electrical apparatus is attached to the base, wherein the insulated radiating rubber molded article is made of a rubber material which is blended with an insulative heat conductive filler, wherein the insulated radiating rubber molded article is provided with a flat surface section, an attaching screw surrounding portion extending outward from the flat surface section that is configured to surround an attaching screw, and a lateral surface section, the flat surface section being arranged between said electrical apparatus and the base, the lateral surface section being arranged around said electrical apparatus, and the attaching screw surrounding portion being located inboard from the lateral surface section, and wherein the attaching screw surrounding portion is a cylindrical projection including an interior surface and an exterior surface, and the exterior surface is located inboard from the lateral surface section.

2. The insulated radiating rubber molded article according to claim 1, wherein said lateral surface section and/or the attaching screw surrounding portion is set so that a height is equal to or more than a thickness of said electrical apparatus.

3. The insulated radiating rubber molded article according to claim 2, wherein said electrical apparatus is constructed by a lighting equipment, particularly an LED package.

4. The insulated radiating rubber molded article according to claim 1, wherein said electrical apparatus is constructed by a lighting equipment, particularly an LED package.

5. The insulated radiating rubber molded article according to claim 1, wherein the flat surface section and the lateral surface section each have the same thickness.

* * * * *